United States Patent [19]

Beck

[11] 4,444,267

[45] Apr. 24, 1984

[54] BALL VALVE HOUSING

[75] Inventor: Harold K. Beck, Duncan, Okla.

[73] Assignee: Halliburton Company, Duncan, Okla.

[21] Appl. No.: 307,913

[22] Filed: Dec. 30, 1981

[51] Int. Cl.[3] ..... E21B 34/12

[52] U.S. Cl. ..... 166/330

[58] Field of Search ..... 251/63.4; 166/316, 330, 166/331

[56] References Cited

U.S. PATENT DOCUMENTS

| | | | |
|---|---|---|---|
| 4,210,207 | 7/1980 | McStravick et al. | 166/330 |
| 4,352,366 | 10/1982 | Fisher, Jr. | 251/63.4 |
| 4,372,392 | 2/1983 | Barrington et al. | 166/330 |

*Primary Examiner*—Stephen J. Novosad
*Assistant Examiner*—William P. Neuder
*Attorney, Agent, or Firm*—James R. Duzan; Thomas R. Weaver

[57] ABSTRACT

An improved valve member retention assembly comprising a cage assembly containing the lower valve seat and spherical valve member therein.

3 Claims, 2 Drawing Figures

BALL VALVE HOUSING

BACKGROUND OF THE INVENTION

This invention relates to an improved valve member retention assembly for a spherical valve member utilized in well testing apparatus.

During the course of drilling an oil well, one operation which is often performed is to lower a testing string into the well to test the production capabilities of the hydrocarbon producing underground formations intersected by the well. This testing is accomplished by lowering a string of pipe, commonly referred to as drill pipe, into the well with a formation tester valve attached to the lower end of the string of pipe and oriented in a closed position, and with a packer attached below the formation tester valve. This string of pipe with the attached testing equipment is generally referred to as a well test string.

Once the test string is lowered to the desired final position, the packer means is set to seal off the annulus between the test string and a well casing, and the formation tester valve is opened to allow the underground formation to produce through the test string.

During the lowering of the test string into the well, it is desirable to be able to pressure test the string of drill pipe periodically so as to determine whether there is any leakage at the joints between successive stands of drill pipe.

To accomplish this drill pipe pressure testing, the string of drill pipe is filled with a fluid and the lowering of the pipe is periodically stopped. When the lowering of the pipe is stopped, the fluid in the string of drill pipe is pressurized to determine whether there are any leaks in the drill pipe above the formation tester valve.

With the apparatus and methods generally used in the prior art for testing the drill pipe as it is lowered into the well, the fluid in the string of pipe is generally contained within the drill pipe only by the closure of the formation tester valve. In other words, the pressure exerted on the fluid in the drill pipe is also exerted against the closed formation tester valve.

This prior art arrangement has often been utilized with a formation tester valve similar to that shown in U.S. Pat. No. 3,856,085 to Holden, et al assigned to the assignee of the present invention. The Holden, et al formation tester valve has a spherical valve member contained between upper and lower valve member seats.

The Holden, et al formation tester valve is shown only schematically in U.S. Pat. No. 3,856,085, and the details of the mounting of the spherical valve member within the housing of the valve are not thereshown. The actual formation tester valve constructed according to the principles of Holden, et al U.S. Pat. No. 3,856,085 has the upper valve seat for the spherical valve member suspended from an inner mandrel which is hung off an annular shoulder of the outer valve housing, in a manner similar to that shown in U.S. Pat. No. Re. 29,471 to Giroux, and assigned to the asignee of the present invention. The lower valve seat is connected to the upper valve seat by a plurality of C-clamps spanning around the spherical valve member. The lower valve seat member of the Holden, et al formation tester valve does not, therefore, engage any supporting portions of the valve housing.

The spherical valve member of the Holden, et al formation tester valve is held in place within the housing so as to prevent axial movement of the spherical valve member relative to the housing, and is engaged by eccentric lugs mounted on a sliding member which does move axially relative to the housing so that upon axial movement of the lugs relative to the housing, the spherical valve member is rotated relative to the housing to open and close the valve.

When pressure testing drill pipe located above a formation tester valve like that of Holden, et al, experience has shown that excessive pressure exerted upon the top surface of the spherical valve member of the Holden, et al apparatus causes the spherical valve member to exert a downward force on the eccentric lugs thereby shearing the eccentric lugs off their carrying member. This severely limits the maximum pressure which may be exerted upon the fluid within the drill pipe to pressure test the same, and it is particularly a significant problem in very deep wells where the mere hydrostatic pressure of the fluid within the drill pipe is relatively high. It has been determined that the maximum differential pressure which can safely be carried by the Holden, et al valve is about 5000 psi.

Another prior art valve having a spherical valve member which does not move axially relative to its housing is the subsea test tree valve shown in U.S. Pat. No. 4,116,272 to Barrington.

Other prior art valves having a spherical valve member which does move axially relative to the housing are shown in U.S. Pat. No. 4,064,937 to Barrington; U.S. Pat. No. 3,568,715 to Taylor, Jr.; U.S. Pat. No. Re. 27,464 to Taylor, Jr.; U.S. Pat. No. 4,009,753 to McGill, et al; and U.S. Pat. No. 3,967,647 to Young.

To eliminate the use of C-clamps spanning around the spherical valve member and secure the spherical valve member within the housing to prevent relative axial movement between the two the present invention of an improved valve member retention assembly comprising a cage assembly containing the lower valve seat and spherical valve member therein is provided.

DESCRIPTION OF THE INVENTION

Figure 1:
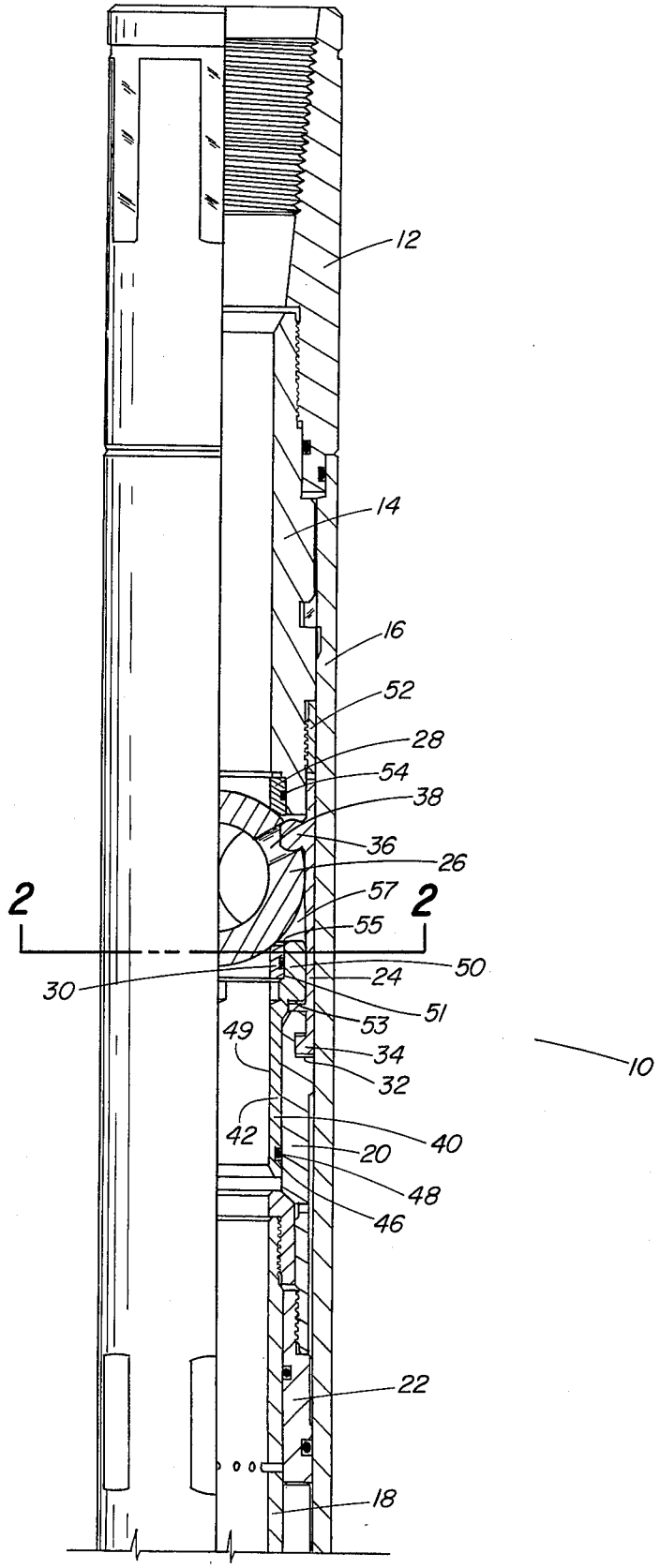
FIG. 1 is a cross-sectional view of the present invention in a typical down-hole tool having a spherical valve member actuated by an eccentric lug on a sliding member.

Referring to FIG. 1, the present invention is shown installed in a typical spherical valve member testing tool 10 such as described by Holden in U.S. Pat. No. 3,856,085.

The typical spherical valve member testing tool 10 comprises an adapter 12, upper mandrel 14, outer case 16, lower mandrel 18, power mandrel 20, piston 22 connected to one end of the power mandrel 20, a plurality of actuating arms 24, spherical valve member 26, upper valve seat 28 and lower valve seat 30. The typical spherical valve member testing tool 10 also contains further assemblies and elements which are not shown and are not pertinent to the present invention.

The power mandrel 20 includes an annular recess 32 which receives the end portion 34 of each actuating arm 24 therein. Each actuating arm 24 further includes an eccentric lug 36 thereon which mates with an aperture 38 in the spherical valve member 26 to cause movement of the spherical valve member 26 when the piston 22, power mandrel 20 and lower mandrel 18 move axially within the outer case 16.

A valve cage 40, the present invention, retains the lower valve seat 30, spherical valve member 26 and upper valve seat 28 within the testing tool 10 to prevent axial movement of the spherical valve member 26 therein. The valve cage 40 comprises a cylindrical annular member 42 having a lower portion 44 having a annular recess 46 in the outer surface thereof which contains an annular elastomeric seal means 48 therein which sealingly engages a portion of the power mandrel 20 and having a bore 49 therethrough, an intermediate portion 50 having a bore 51 which receives lower valve seat 50 therein, having annular shoulder 53 which abuts one end of lower valve seat 30, having annular chamfered surface 55 in one end thereof adjacent the end of the lower valve seat which engages the spherical valve member, having valve portion 57 which slidably receives a portion of the plurality of actuating arms 24 thereon in axial recesses 56 (see FIG. 2) and the spherical valve member 26 therein, and an upper portion 52 which is secured to the upper mandrel 14 to retain the spherical valve member 26 from axial movement within the testing tool 10. Although the valve cage 40 has been shown as being secured to the upper mandrel 14 by means of threaded engagement, any suitable attachment means may be utilized which allows for easy assembly and disassembly of the tool 10.

The upper valve seat 28 is retained within an annular recess 54 of the upper mandrel 14 and is held in engagement with the spherical valve member 26 by the cage 40 being secured to the upper mandrel 14.

Each actuating arm 24 is arcuate in cross-sectional shape and is slidably retained within an axial recess 56 (shown in FIG. 2) in the exterior surface of the valve cage 40.

Figure 2:
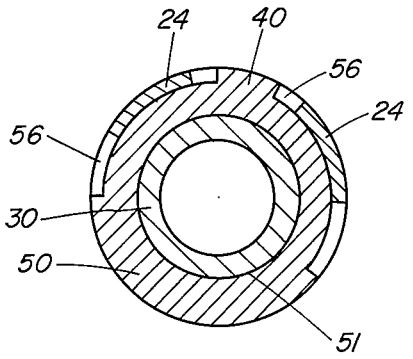
FIG. 2 is a view along line 2—2 of FIG. 1.

Referring to FIG. 2, the intermediate portion 50 of the valve cage 40 is shown in cross-section along with the lower valve seat 30 and actuating arms 24. As shown, each actuating arm 24 is received within axial recess 56 of the valve cage 40.

Referring again to FIG. 1, as can be seen the valve cage 40 which retains and supports the spherical valve member 26 and its associated upper 28 and lower 30 valve seats therein is secured to the upper mandrel 14 thereby preventing excessive axial movement of the spherical valve member 26 within the testing tool 10. By utilizing the valve cage 40 to retain and support the spherical valve member 26 and its associated upper 28 and lower 30 valve seats within the testing tool 10, rather than utilizing a plurality of C-clamps spanning around the spherical valve member 26 to retain the lower valve seat in position, a greater amount of differential fluid pressure force may be exerted across the spherical valve member 24 without the attendant shearing of the eccentric lugs 36 of the actuation arms 24.

For instance, whereas the maximum differential fluid pressure force which may be safely carried by the spherical valve member in a testing tool as described in the Holden, et al patent, U.S. Pat. No. 3,856,085, is approximately 5000 psi, a similar tool utilizing the valve cage of the present invention to carry the spherical valve member may safely carry a maximum differential fluid pressure force of approximately 19,000 psi or more.

Additionally, by utilizing the valve cage 40 of the present invention to retain the spherical valve member 26 within the testing tool 10 by threadedly securing the cage 40 to the upper mandrel 14 the testing tool 10 is more easily manufactured than that described by Holden, et al is more easily assembled than that described by Holden, et al and the amount of clearance between the upper 28 and lower 30 valve seats and the cage 40 and upper mandrel 14 is easily adjusted than that described by Holden, et al.

Having thus described my invention, I claim:

1. A well testing apparatus having an annular adapter, annular outer case, annular upper mandrel including an annular recess in the interior in one end thereof, annular power mandrel, an actuation arm having a lug thereon, annular lower mandrel, and a spherical valve member having recesses therein, a bore therethrough, and being restrained from axial movement within said valve testing apparatus between an upper valve seat received and retained in the annular recess in the end of the annular upper mandrel and lower valve seat by a valve cage, said spherical valve member movable within said well testing apparatus by the lug means of said actuation arm engaging the recesses in said spherical valve member, said valve cage comprising:

an annular elongated cylindrical member having a lower portion having a bore therethrough, an intermediate portion having said lower valve seat retained therein abutting an annular shoulder in the intermediate portion and an axial recess in the exterior surface thereof slidably retaining said actuation arm therein, a valve portion which slidably receives a portion of said actuation arm therein, and an upper portion releasably secured to said annular upper mandrel to retain said spherical valve member from axial movement within said testing apparatus.

2. The well testing apparatus of claim 1 wherein said cage means further comprises an annular chamfered surface at one end of the bore in the intermediate portion adjacent the end of said lower valve seat which engages said spherical valve member.

3. A well testing apparatus having an annular adapter, annular outer case, annular upper mandrel, having a recess in the interior in one end thereof, annular power mandrel, actuation arm having a lug thereon, annular lower mandrel, and a spherical valve member having recesses therein, a bore therethrough, and being restrained from axial movement within said valve testing apparatus between an upper valve seat and lower valve seat by a valve cage, said spherical valve member movable within said well testing apparatus by the lug of said actuation arm engaging the recesses in said spherical valve member, said valve cage comprising:

an annular cylindrical member having axial recess in the exterior surface thereof slidably retaining said actuation arm therein, having an intermediate portion having a bore therein which receives said lower valve seat therein, an annular shoulder which abuts one end of said lower valve seat, an annular chamfered surface at one end of the bore therein adjacent the end of said lower valve seat which engages said spherical valve member, having a valve portion receiving said spherical valve member therein and an upper portion releasably secured to said annular upper mandrel to retain said spherical valve member from axial movement within said testing tool.

* * * * *